US008418882B2

(12) United States Patent
Stern et al.

(10) Patent No.: US 8,418,882 B2
(45) Date of Patent: Apr. 16, 2013

(54) APPLICATOR

(75) Inventors: Ruth Stern, Toronto, CA (US); Pauline Ashworth, Toronto, CA (US); Greg McEwan, Cobourg, CA (US); Robert McColman, Toronto, CA (US)

(73) Assignee: Colour Revoluntion Inc., Toronto, Ontario (CA)

( * ) Notice: Subject to any disclaimer, the term of this patent is extended or adjusted under 35 U.S.C. 154(b) by 333 days.

(21) Appl. No.: 12/780,019

(22) Filed: May 14, 2010

(65) Prior Publication Data

US 2010/0288297 A1 Nov. 18, 2010

(30) Foreign Application Priority Data

May 14, 2009 (CA) ..... 2666080

(51) Int. Cl.
*B67D 1/00* (2006.01)
*B65D 35/28* (2006.01)

(52) U.S. Cl.
USPC ..... 222/82; 222/91; 222/94; 222/103; 222/136; 222/145.6; 222/325

(58) Field of Classification Search ..... 222/82, 222/88, 89, 91, 94, 103, 105, 136, 145.6, 222/325; 132/221
See application file for complete search history.

(56) References Cited

U.S. PATENT DOCUMENTS

| | | | | |
|---|---|---|---|---|
| 1,242,165 | A * | 10/1917 | Fitzgerald | 222/103 |
| 2,539,457 | A | 1/1951 | Metheny et al. | |
| 2,562,402 | A | 8/1951 | Winsten | |
| 2,819,723 | A | 1/1958 | Meyer | |
| 2,857,079 | A * | 10/1958 | Hall | 222/103 |
| 3,302,832 | A * | 2/1967 | Anderson et al. | 222/94 |
| 3,570,499 | A | 3/1971 | Ruta | |
| 3,782,600 | A * | 1/1974 | Columbus | 222/94 |
| 3,789,844 | A | 2/1974 | Burges | |
| 4,040,420 | A | 8/1977 | Speer | |
| 4,207,725 | A | 6/1980 | Smith | |
| 4,631,055 | A | 12/1986 | Redl et al. | |
| 4,978,336 | A | 12/1990 | Capozzi | |
| 5,037,639 | A | 8/1991 | Tung | |
| 5,161,715 | A * | 11/1992 | Giannuzzi | 222/82 |
| 5,184,757 | A | 2/1993 | Giannuzzi | |
| 5,247,746 | A | 9/1993 | Johnson et al. | |
| 5,290,259 | A | 3/1994 | Fischer | |
| 5,328,462 | A | 7/1994 | Fischer | |
| 5,337,764 | A | 8/1994 | McKay | |
| 5,339,839 | A | 8/1994 | Forcelledo et al. | |
| 5,356,439 | A | 10/1994 | Schultz et al. | |
| 5,376,006 | A | 12/1994 | Fisher | |
| 5,435,462 | A * | 7/1995 | Fujii | 222/82 |

(Continued)

FOREIGN PATENT DOCUMENTS

| | | |
|---|---|---|
| JP | 11-128314 | 5/1999 |
| WO | WO00/21842 | 4/2000 |
| WO | WO2005032300 | 4/2005 |

*Primary Examiner* — Kevin P Shaver
*Assistant Examiner* — Patrick M Buechner
(74) *Attorney, Agent, or Firm* — Philip C. Mendes da Costa; Bereskin & Parr LLP/S.E.n.C.R.L., s.r.l.

(57) ABSTRACT

An applicator is provided with a volume for receiving one or more disposable or refillable container containing a hair treatment composition. The applicator is provided with opposed arms that are configured such that, when the arms are brought towards each other, the hair treatment composition is dispensed.

19 Claims, 8 Drawing Sheets

U.S. PATENT DOCUMENTS

| | | | | |
|---|---|---|---|---|
| 5,534,244 | A | 7/1996 | Tung | |
| 5,622,283 | A * | 4/1997 | Morrison | 222/103 |
| 5,725,499 | A | 3/1998 | Silverstein et al. | |
| 5,725,843 | A | 3/1998 | Fisher | |
| 5,746,598 | A | 5/1998 | Fischer | |
| 5,819,988 | A | 10/1998 | Sawhney et al. | |
| 5,851,512 | A | 12/1998 | Fischer | |
| 5,855,870 | A | 1/1999 | Fischer | |
| 5,897,028 | A * | 4/1999 | Sauer | 222/82 |
| 5,985,249 | A | 11/1999 | Fischer | |
| 6,019,251 | A * | 2/2000 | Koga | 222/94 |
| 6,036,005 | A | 3/2000 | Krause et al. | |
| 6,036,943 | A | 3/2000 | Fischer | |
| 6,056,930 | A | 5/2000 | Tung | |
| 6,065,645 | A | 5/2000 | Sawhney et al. | |
| 6,089,855 | A | 7/2000 | Becker et al. | |
| 6,183,251 | B1 | 2/2001 | Fischer | |
| 6,260,557 | B1 | 7/2001 | Yarbrough | |
| 6,306,370 | B1 | 10/2001 | Jensen | |
| 6,309,625 | B1 | 10/2001 | Jensen et al. | |
| 6,368,576 | B1 | 4/2002 | Jensen et al. | |
| 6,394,314 | B1 | 5/2002 | Sawhney et al. | |
| 6,564,972 | B2 | 5/2003 | Sawhney et al. | |
| 6,565,615 | B1 | 5/2003 | Wong et al. | |
| 6,698,622 | B2 | 3/2004 | Sawhney et al. | |
| 6,834,778 | B2 | 12/2004 | Jinbo et al. | |
| 6,889,870 | B2 * | 5/2005 | De Laforcade | 222/103 |
| 2002/0015663 | A1 | 2/2002 | Goldstein et al. | |
| 2002/0148480 | A1 | 10/2002 | Chu et al. | |
| 2004/0221864 | A1 | 11/2004 | Capristo | |
| 2005/0028833 | A1 | 2/2005 | Vena et al. | |
| 2005/0211261 | A1 | 9/2005 | Capristo | |
| 2009/0084815 | A1 * | 4/2009 | Paetow et al. | 222/94 |

* cited by examiner

APPLICATOR

CROSS REFERENCES TO RELATED APPLICATIONS

This application claims priority from Canadian Patent Application 2,666,080, filed on May 14, 2009, which is incorporated herein by reference in its entirety.

FIELD

The specification relates to applicators. More specifically, the specification relates to applicators for dispensing a multi-component hair treatment product.

INTRODUCTION

The following is not an admission that anything discussed below is prior art or part of the common general knowledge of persons skilled in the art.

The most common method of dyeing human hair is oxidative dyeing. Various formulations for use in oxidative hair dyeing or coloring are well known in the art. Such formulations typically involve the use of a two-part system. One part, the dye component, contains at least one primary intermediate and at least one coupler. For example, the dye component may contain diaminobenzenes, dihydroxybenzenes and aminophenols. Before use, this dye component is mixed with a second part, which is a developer formulation containing an oxidizing agent, such as hydrogen peroxide or other strong oxidizing agent. The developer oxidizes the primary intermediate (e.g. the benzenes), which then reacts with the coupler (e.g. the aminophenols) to form a colored compound. See for example U.S. Pat. No. 6,565,615 (Wong et al).

SUMMARY

The following introduction is provided to introduce the reader to the more detailed discussion to follow. The introduction is not intended to limit or define the claims.

An applicator is disclosed herein for dispensing a multi-component hair treatment product, such as a dye and developer. The dye and developer may be provided in first and second containers. The applicator is configured to dispense the components from the containers, mix the components, and dispense the mixed components.

Preferably, the use of the applicator involves only a single actuation step. That is, preferably, a user may carry out a single step, such as squeezing, to dispense the components from the containers, mix the components, and dispense the mixed components.

Preferably, the components are mixed as they are dispensed. Accordingly, if desired, only a small portion of each component may be dispensed and mixed. The remainder of each component may be stored for later use. Accordingly, the applicator may be used for root touch-ups, or for skin tests.

Further, preferably, the applicator is reusable. For example, the containers may be mounted to the applicator, the applicator may be used to dispense the components from the containers, mix the components, and dispense the mixed components, and the containers may subsequently be removed from the applicator and discarded. The applicator may then be washed, and reused. Accordingly, the only waste products produced may be the first and second containers. Accordingly, it is preferred that the containers are separate elements that are individually releasably mountable to the applicator.

According to a first broad aspect, an applicator is provided for dispensing a multi-component hair treatment product that is provided in at least first and second containers. The applicator comprises a base. A nozzle is provided on the base, and the containers are mountable to the base in fluid flow communication with the nozzle. A first panel and a second panel are provided, at least one of which is mounted on the base. At least one of the first panel and the second panel are movable toward the other of the first panel and the second panel to compress the containers when the containers are positioned between the first panel and the second panel.

According to a second broad aspect, an applicator is provided for dispensing a two component hair treatment product that is provided in at least one container. The applicator comprises a base. A nozzle is provided on the base. The at least one container is mountable to the base in fluid flow communication with the nozzle. A first panel and a second panel are provided, at least one of which is mounted on the base. At least one of the first panel and the second panel are movable towards the other of the first panel and the second panel to compress the at least one container when the at least one container is positioned between the first panel and the second panel.

It will be appreciated that both components may be in a single container that has separate compartments, one for each component. Preferably, each component is in a separate container, e.g., a deformable tube, and each is individually mountable to the applicator, such as by being screwed onto the base. Each tube may be sealed, such as by a foil seal. The foil seal may be pierced as the tubes are screwed onto the base.

DRAWINGS

The drawings included herewith are for illustrating various examples of articles, methods, and apparatuses of the present specification and are not intended to limit the scope of what is taught in any way. In the drawings.

DESCRIPTION OF VARIOUS EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Referring to FIGS. 1 to 4, an embodiment of an applicator 100 is shown. The applicator 100 is usable for dispensing a multi-component hair treatment product. For example, the multi-component hair treatment product may comprise a dye, and a developer, as is known in the art. Preferably, the dye may comprise a primary intermediate and a coupler, and the developer may comprise an oxidizing agent. As is known in the art, such dyes and developers are typically stored separately until just prior to use. When ready for use, the dye and the developer are mixed, and immediately applied to the hair of a user. Accordingly, the multi-component hair treatment product is preferably provided in first and second containers. For example, the dye may be provided in a first container, and the developer may be provided in a second container. The applicator 100 is usable to dispense the components from the first and second containers. Preferably the components are mixed as they are dispensed.

Figure 5:
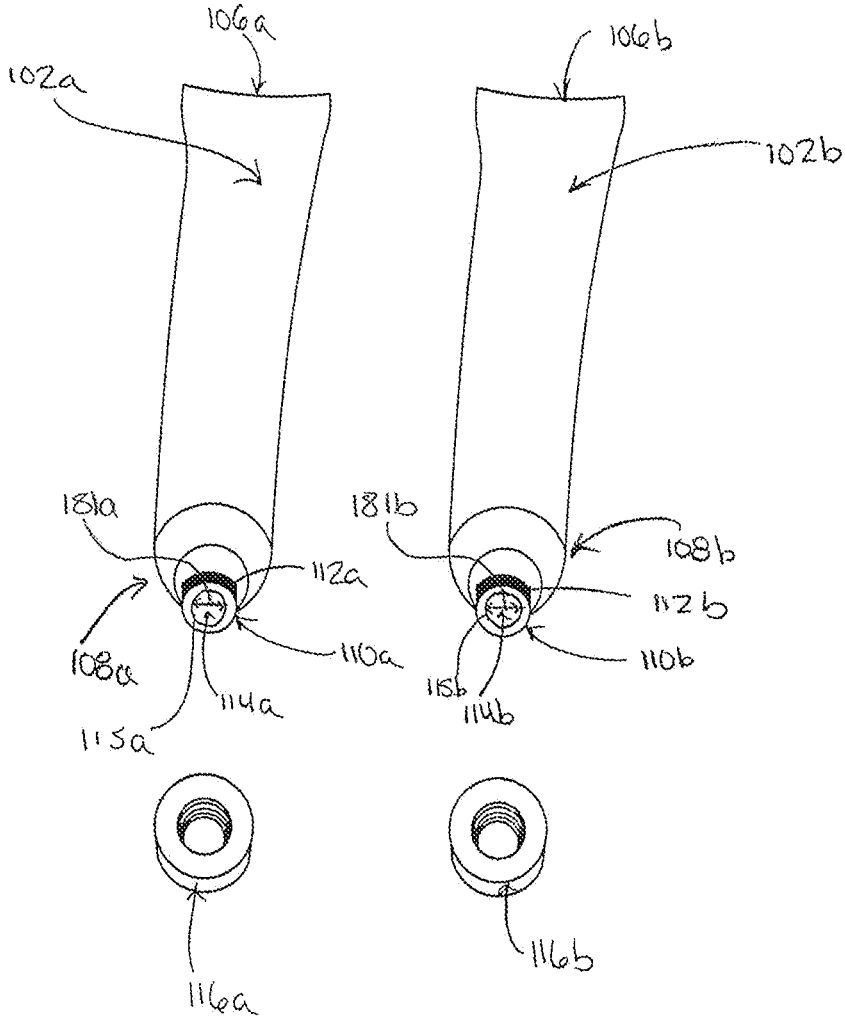
FIG. 5 is a perspective illustration of an example of first and second containers that are usable with the applicator of FIG. 1.

Referring to FIG. 5, an example of a first 102*a* and a second 102*b* container usable with the applicator 100 are shown. The first container 102*a* may be used to store the dye, and the second container 102*b* may be used to store the developer (or vice versa). As shown, each container 102*a*, 102*b* is a squeeze tube 102*a*, 102*b*. The squeeze tubes 102*a*, 102*b* may be of any configuration known in the art, and are generally configured to store a material, and to dispense the material when pressure is applied to the tube to compress the tube (i.e. when the tube is squeezed). The squeeze tubes 102*a*, 102*b* may be made from any suitable material, such as a laminate, a metal such as aluminum, or a plastic. Preferably, the tubes are not resilient, i.e., they will not expand when pressure is removed.

The squeeze tubes 102*a*, 102*b* each comprise a first end 106*a*, 106*b*, respectively, and a second end 108*a*, 108*b*, respectively. As shown, the squeeze tubes 102*a*, 102*b* are generally flat at the first ends 106*a*, 106*b*, and are generally rounded at the second ends 108*a*, 108*b*. The second ends 108*a*, 108*b* each comprise an outlet port 110*a*, 110*b*, respectively. As shown, the outlet ports 110*a*, 110*b* each have a threaded outer surface 112*a*, 112*b*, and have an outlet passage 114*a*, 114*b* extending longitudinally therethrough. The outlet passages 114*a*, 114*b* have a first open end (not shown) in communication with the interior of the tube, and a second open end 115*a*, 115*b* in communication with the outside environment. When the squeeze tubes 102*a*, 102*b* are squeezed, the material housed therein is dispensed through the second open ends 115*a*, 115*b*, respectively. As shown, the squeeze tubes 102*a*, 102*b* are each provided with a cap 116*a*, 116*b*. The caps 116*a*, 116*b* are threadably receivable on the threaded outer surfaces 112*a*, 112*b* of the outlet passages 114*a*, 114*b*, respectively, to close the second open ends 115*a*, 115*b*.

It will be appreciated that squeeze tubes 102*a*, 102*b* may be mounted, and preferably removably mounted, to applicator 100 by any means known in the art, such as a press fit, a bayonet mount, an exterior clamping member or the like.

In some embodiments, the first 102*a*, and second 102*b* squeeze tubes may be provided with a seal, such as a rupturable seal. For example, rupturable foil seals (not shown) may be provided across second open ends 115*a*, 115*b*, respectively. Alternately, the rupturable seal may comprise a wax, or a plastic seal, for example. The seal may be removably prior to mounting the tubes to the applicator, such as by providing each seal with a pull tab.

Referring back to FIGS. 1 to 4, the applicator 100 is configured to dispense the components from the containers 102*a*, 102*b*, mix the components, and dispense the mixed components. Accordingly, a user may easily apply the components to their own (or another person's) hair. For example, after mounting the containers the applicator, the user may actuate the applicator to dispense the components from the containers 102*a*, 102*b*, mix the components, and dispense the mixed components. Preferably, the step of actuating the applicator comprises only a single motion. For example, in the embodiment shown, the user needs only to squeeze the applicator in order to dispense the components from the containers 102*a*, 102*b*, mix the components, and dispense the mixed components.

In the embodiment shown, the applicator 100 comprises a base 120, a nozzle 122 provided on the base 120, and first 124 and second 126 panels provided on the base 120. The panels 124, 126 are usable to compress the containers 102*a*, 102*b* to dispense the components therefrom, the nozzle 122 serves to optionally mix the components and dispense the mixed components, and the base 120 mounts the containers in fluid flow communication with the nozzle 122.

Figure 1:
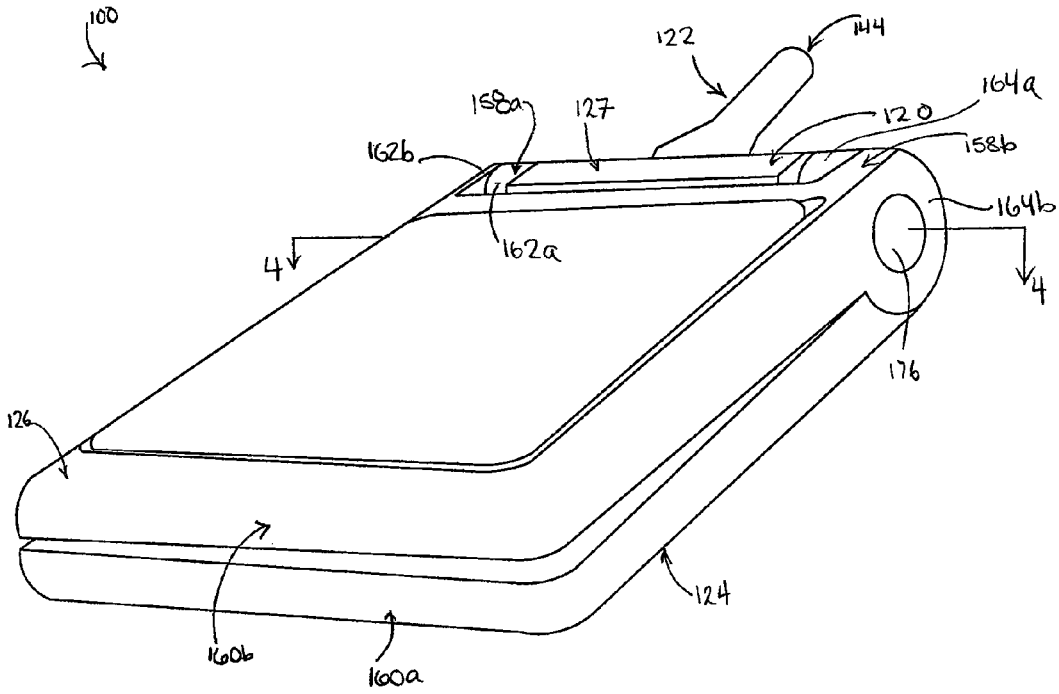
FIG. 1 is a perspective illustration of an example of an applicator according to a first embodiment.
Figure 2:
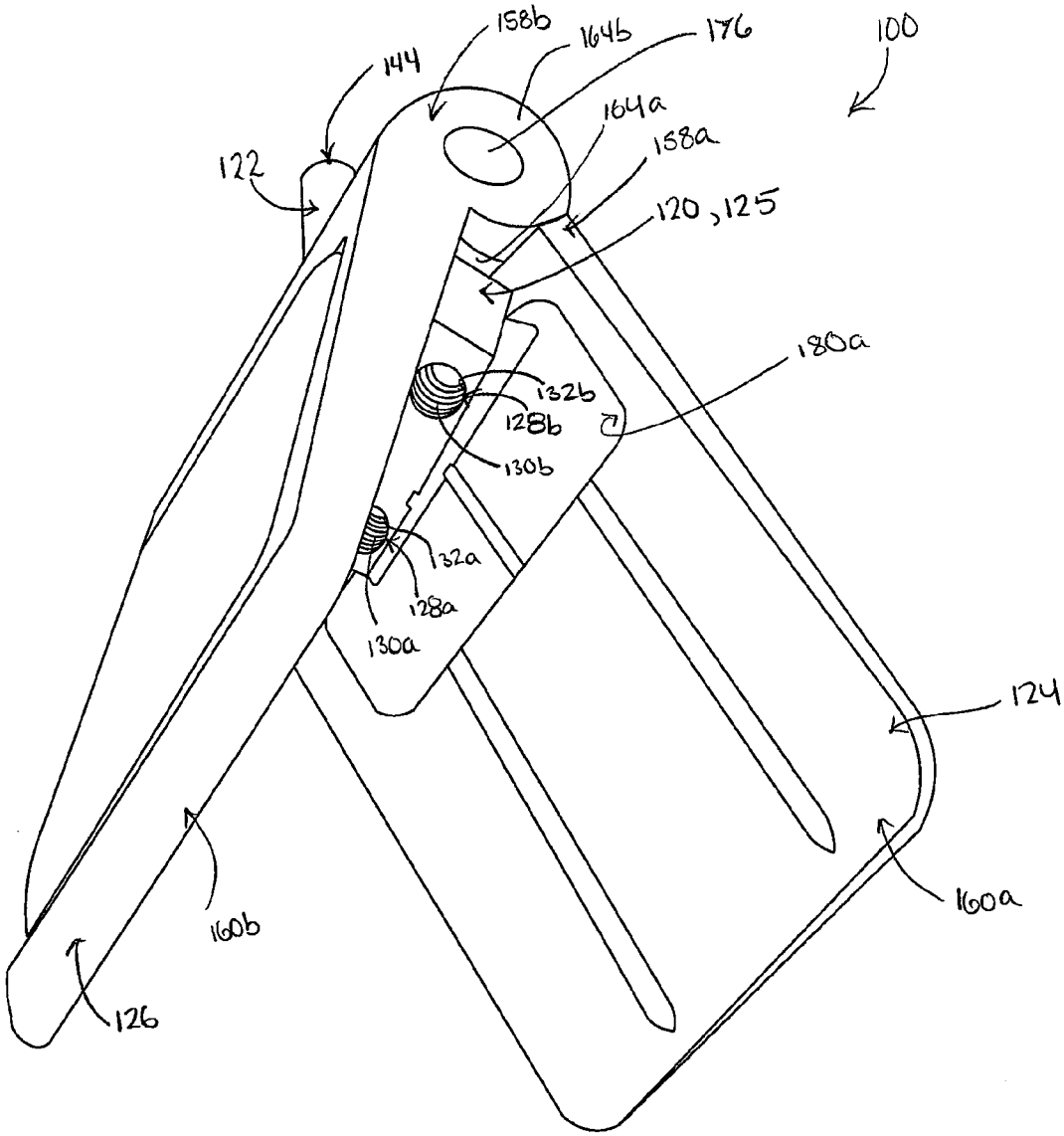
FIG. 2 is a perspective illustration of the applicator of FIG. 1, showing the panels pivoted away from each other.
Figure 3:
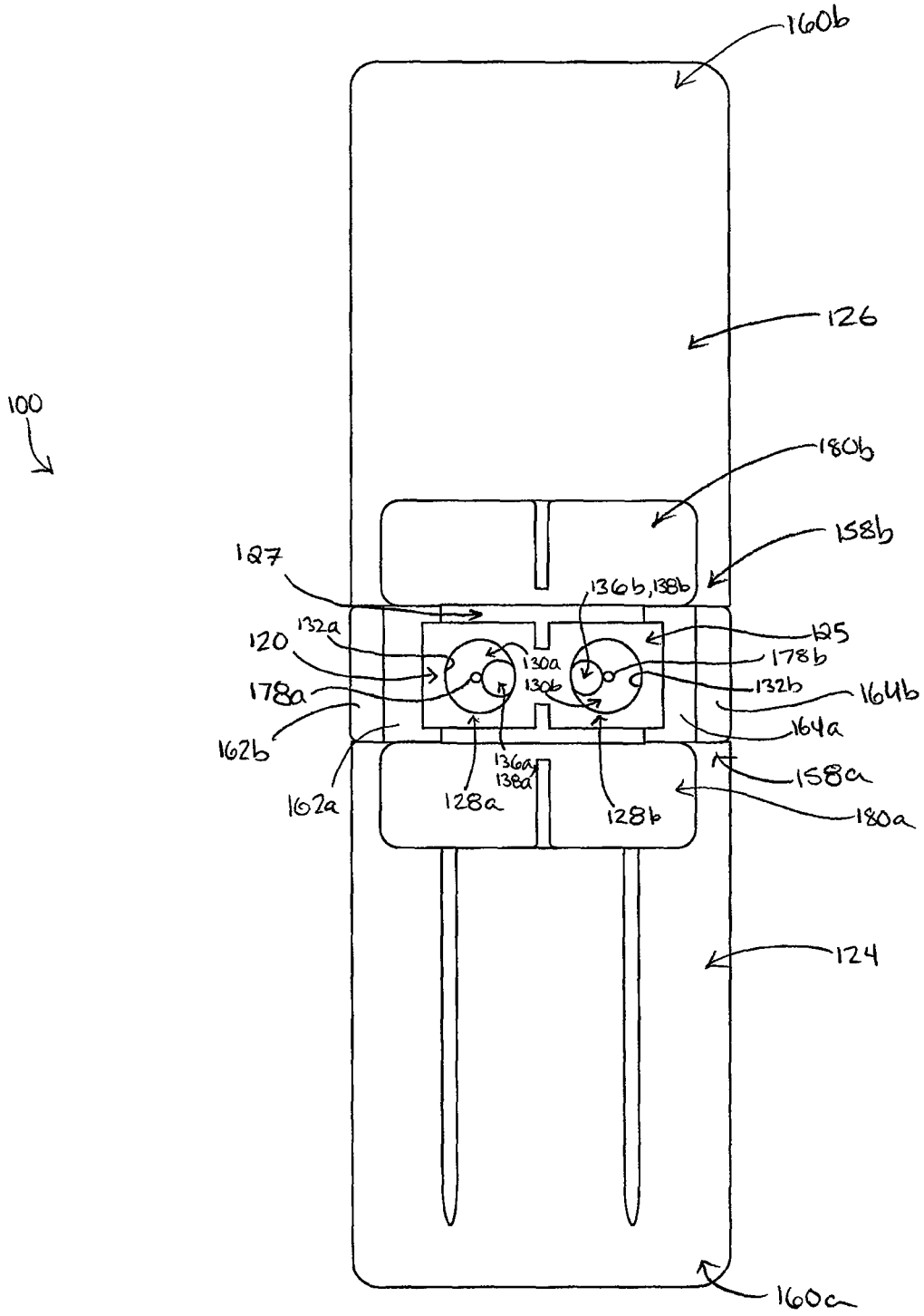
FIG. 3 is a rear plan view of the applicator of FIG. 1, showing the panels pivoted 90° away from each other so as to extend along a common axis.
Figure 4:
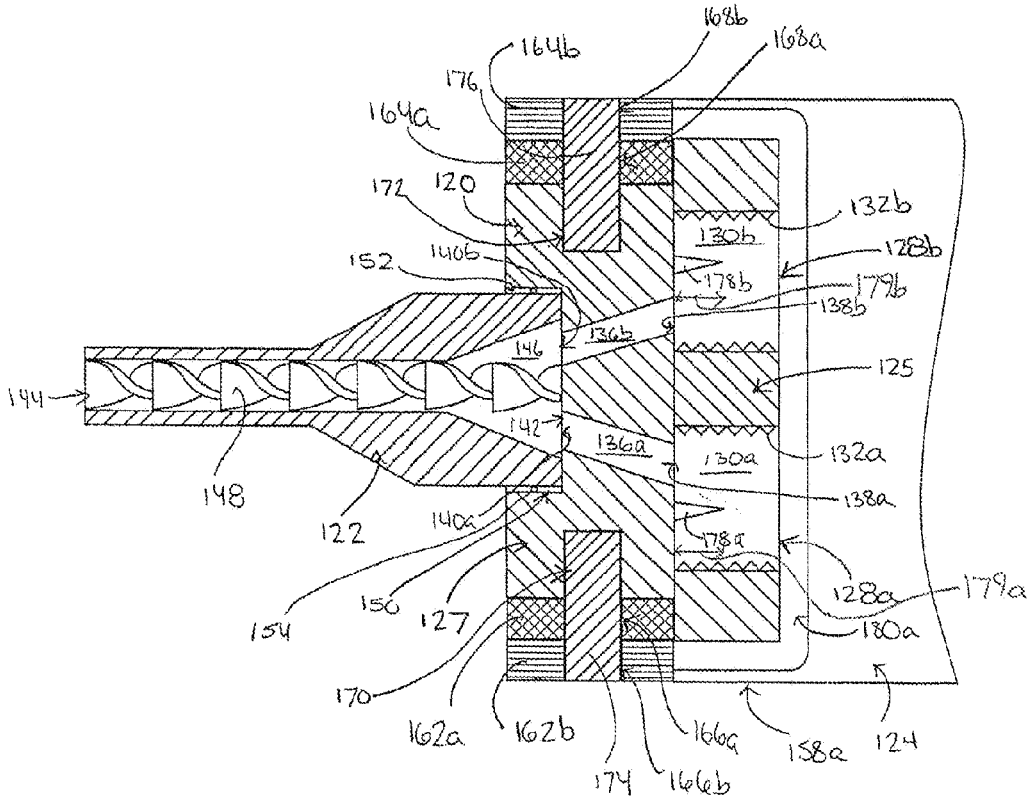
FIG. 4 is a cross-section taken along line 4-4 in FIG. 1.

Referring to FIG. 4, as mentioned hereinabove, in the embodiment shown, the nozzle 122 serves to mix the components, and to dispense the mixed components. That is, the nozzle 122 is a mixer nozzle. For example, as shown, the nozzle comprises an inlet end 142, an outlet end 144, and a nozzle passage 146 extending therebetween. The nozzle passage 146 comprises a mixer rod 148. The mixer rod 148 is configured to mix together the components passing through the nozzle passage 146. For example, in the embodiment shown, if a separate dye and a developer are introduced into the nozzle passage 146 at the inlet end 142, the mixer rod 148 will mix the dye and developer as they pass through the nozzle passage 146, such that they are suitably combined when they exit the nozzle passage at the outlet end 144. For example, as shown, the mixer rod 148 defines a helical flow path through the nozzle passage 146. As the components pass through the helical flow path, they become mixed.

Any construction of a mixer nozzle may be used. For example, the helical flow path may be molded as part of the internal surface of flow path through the nozzle. Accordingly, mixer rod 148 may be the internal surface of the flow path. The nozzle may be permanently mounted to the base (i.e. the nozzle 122 and base 120 may be a one piece unit) or may be removable therefrom for cleaning or replacement.

Figure 6:
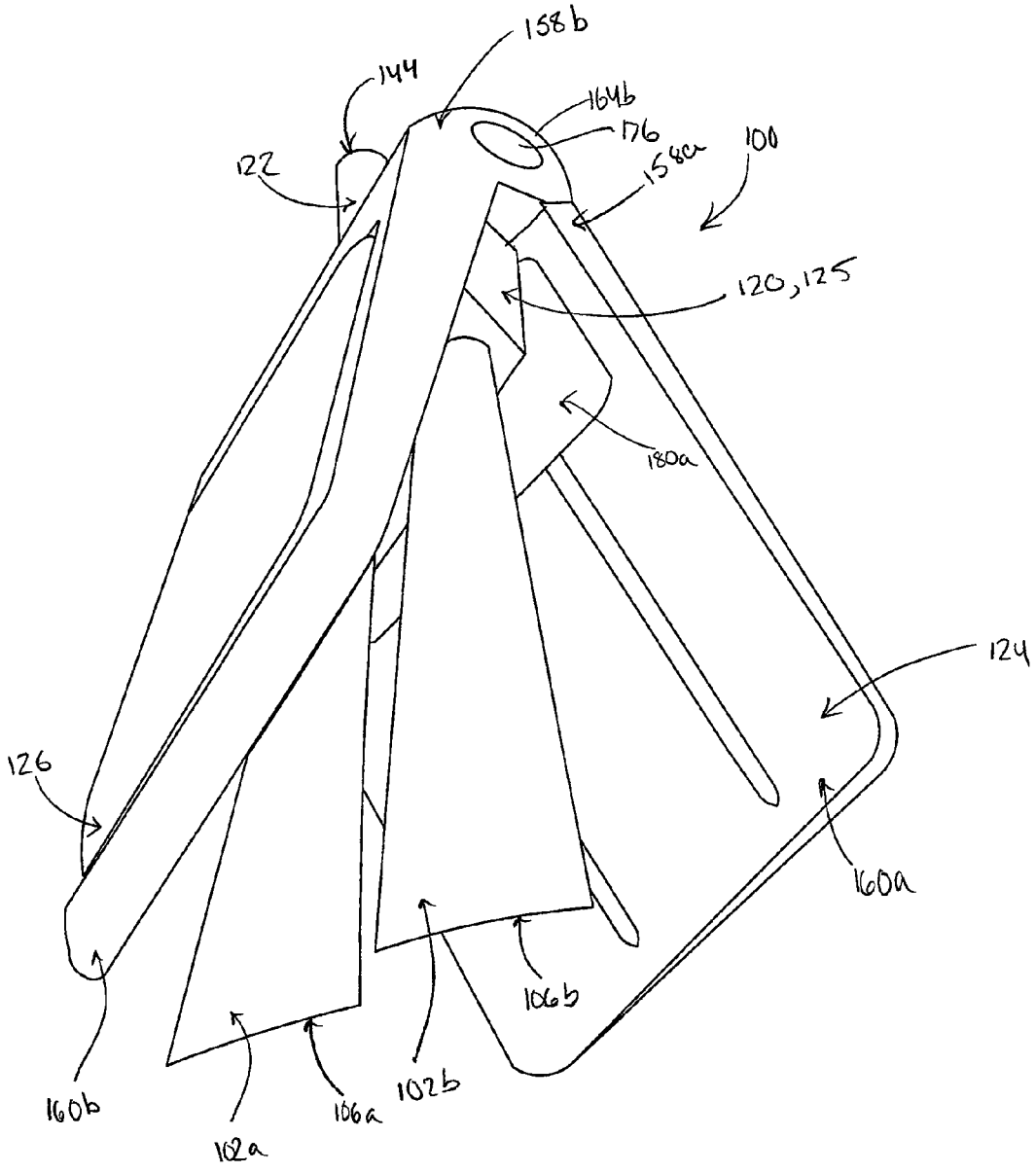
FIG. 6 is a perspective illustration of the applicator of FIG. 1, showing the panels pivoted away from each other to create an open volume such that the first and second containers of FIG. 5 may be mounted to the applicator.

As mentioned hereinabove, the nozzle 122 is provided on the base 120, and the containers are mountable to the base such that they are in fluid flow communication with the nozzle. Preferably, the containers 102*a*, 102*b*, and the nozzle 122 are each removably mounted to the base 120. For example, referring still to FIGS. 1 to 4, as shown, the base comprises a proximal portion 125, and a distal portion 127. The proximal portion 125 comprises first 128*a* and second 128*b* adjacent mounts. Each mount 128*a*, 128*b* comprises a mount passage 130*a*, 130*b* extending longitudinally therethrough. The mount passages 130*a*, 130*b* each comprise a threaded inner surface 132*a*, 132*b*. As shown in FIG. 6, the outlet ports 110*a*, 110*b* of the first 102*a* and second 102*b* squeeze tubes are removably receivable in the mount passages 130*a*, 130*b*, respectively, such that the open ends 115*a*, 115*b* are in communication with the mount passages 130*a*, 130*b*. Further, the threaded outer surfaces 112*a*, 112*b* are mateable with the threaded inner surfaces 132*a*, 132*b*.

Referring still to FIGS. 1 to 4, the distal portion 127 of the base 120 comprises a mount 150 for removably receiving the inlet end 142 of the nozzle 122. For example, as shown, the mount 150 comprises a recess 152, into which the inlet end 142 of the nozzle 122 is insertable. Preferably, a sealing member, such as a gasket 154 is provided for sealing the nozzle 122 in the recess 152. As shown, the nozzle is frictionally secured in the mount 150. In alternate embodiments, the nozzle 122 may be secured to the mount 150 in another manner, for example it may be threadably secured. The distal portion 127 of the base 120 further comprises a first passage 136*a*, and a second passage 136*b*. The first passage 136*a* has a first end 138*a* in communication with passage 130*a*, and a second end 140*a* in communication with recess 152. The second passage 136*b* has a first end 138*b* in communication with passage 130*a*, and a second end 140*b* in communication with recess 152.

Accordingly, in the embodiment shown, the containers 102*a*, 102*b* are in fluid communication with the nozzle 122 via the base. More particularly, the first 102*a* squeeze tube is in communication with the nozzle via the mount passage 130*a* and the first passage 136*a*, and the second squeeze tube 102*b* is in communication with the nozzle via the mount passage 130*b* and the second passage 136*b*.

In alternate embodiments, the base may serve to mount the containers to the nozzle, without providing fluid communication therebetween. That is, the base may provide structural support only, and the containers may be in direct fluid communication with the nozzle 122.

As shown, the proximal portion 125 and distal portion 127 are integrally formed. In alternate embodiments, the proximal portion 125 and distal portion 127 may be separately formed, and may be removably or non-removably mounted together. Further, in alternate embodiments, the nozzle 122 and the base 120 may be a one-piece unit. For example, the nozzle 122 and base 120 may integrally formed, or may be separately formed and may be permanently or semi-permanently secured together, such as by mechanical fasteners or an adhesive.

Preferably, as shown, the base 120 comprises a seal rupture member for each of the containers 102*a*, 102*b*. That is, as mentioned hereinabove, the containers 102*a*, 102*b* may each be provided with a rupturable seal, such as a foil covering provided over outlets 115*a*, 115*b*. The base 120 may be provided with a seal rupture member which ruptures the seals when the containers 102*a*, 102*b* are mounted to the base 120. For example, as shown, the base 120 comprises a first 178*a* and a second 178*b* seal rupture member. Each seal rupture member 178*a*, 178*b* comprises a longitudinally extending member, such as a spike or a pin. The first seal rupture member 178*a* extends outwardly from the distal portion 127 of the base 120, and into the first mount passage 130*a*. The second seal rupture member 178*b* extends outwardly from the distal portion 127 of the base 120 and into the second mount passage 130*b*. Preferably, the length 179*a*, 179*b*, of each seal rupture member 178*a*, 178*b* is at least as long as the diameter 181*a*, 181*b* of each seal. In some embodiments, the seal rupture members 178*a*, 178*b* may comprise a passage extending longitudinally therethrough (not shown).

Referring to FIGS. 1-3, and 6-7, as noted hereinabove, the panels 124, 126 are usable to compress the containers 102*a*, 102*b* to dispense the components therefrom. Preferably, at least one of the panels 124, 126 is movable towards the other of the panels 124, 126 to compress the containers 102*a*, 102*b* when the containers 102*a*, 102*b* are positioned between the panels 124, 126. Optionally, both panels 124, 126 may be moveable. The panels 124, 126 may be arms that extend outwardly from the base 120.

In the embodiment shown, both of the panels 124, 126 are movable towards each other. Specifically, in the embodiment shown, the panels 124, 126 each have a first or proximal end 158*a*, 158*b*, respectively, proximate the base 120, and a second or distal end 160*a*, 160*b*, respectively, spaced from the base 120. The first ends 158*a*, 158*b* are moveably mounted, e.g., pivotally mounted, to the base 120, such that the panels 124, 126 may move or pivot inwardly towards each other to compress the containers 102*a*, 102*b* when the containers 102*a*, 102*b* are positioned in an open volume between the panels 124, 126, and more particularly, when the containers 102*a*, 102*b* are mounted to the base 120.

In the embodiment shown, the first end 158*a* of the first panel 124 comprises a first ear 162*a* and a second ear 164*a* spaced from the first ear. The first ear 162*a* has a first aperture 166*a* extending therethrough, and the second ear 164*a* has a second aperture 168*a* extending therethrough. The first end 158*b* of the second panel 126 also comprises a first ear 162*b* and a second ear 164*b* spaced from the first ear. The first ear 162*b* has a first aperture 166*b* extending therethrough, and the second ear 164*b* has a second aperture 168*b* extending therethrough. The ears 162*a*, 164*a* of the first panel 124 are positionable on opposed sides of the base 120, and the ears 162*b*, 164*b* of the second panel are positionable outwardly of the ears 162*a* 164*a* of the first panel, such that the first apertures 166*a* and 166*b* are aligned, and the second apertures 168*a* and 168*b* are aligned. Further, the distal portion 127 of the base 120 comprises a first base aperture 170 adjacent and aligned with the first apertures 166*a* and 166*b*, and a second base aperture 172 aligned with the second apertures 168*a* and 168*b*. A first pivot pin 174 extends through the first base aperture 170 and the first apertures 166*a* and 166*b*, and a second pivot pin 176 extends through the second base aperture 172 and the second apertures 168*a* and 168*b*. The first 124 and second 126 panels are each pivotal about the pivot pins 174, 176, such that they may move inwardly towards each other and compress the containers 102*a*, 102*b*.

Referring back to FIGS. 1 to 7, in the embodiment shown, the panels 124, 126 each comprise a recess 180*a*, 180*b*, respectively, in which the base 120 is positioned when the panels 124, 126 are pivoted towards each other. Accordingly, the panels 124, 126 may contact and abut each other.

Alternate constructions may be used. For example, the base 120 may have a pivot pin integrally molded therewith on each side on which panels 124, 126 may be mounted. Alternately, one panel may be provided with the pivot pins.

In an alternate embodiment (not shown), only one of the panels 124, 126 may be pivotally mounted to the base 120, and the other panel may be fixedly mounted to the base 120.

In a further alternate embodiment (not shown), one or both of the panels 124, 126 may be removably mounted to the base 120. In a preferred alternate embodiment, the nozzle 122 and the base 120 are a one-piece unit, and the panels 124, 126 are removably secured to the nozzle 122 and base 120. In this embodiment, the panels 124, 126 are preferably also a one-piece unit, to provide ease of assembly. For example, the panels 124, 126 may be pivotally mounted together by a pivot pin or another type of fastener. The panels 124, 126 may be removably secured to the nozzle 122 and base 120 in any suitable fashion, such as by a snap-fit, a bayonet mount, a friction fit, or a latching assembly. This embodiment may allow for the nozzle 122 and base 120 to be disposed of after each use, while allowing the panels 124, 126 to be reused.

Figure 7:
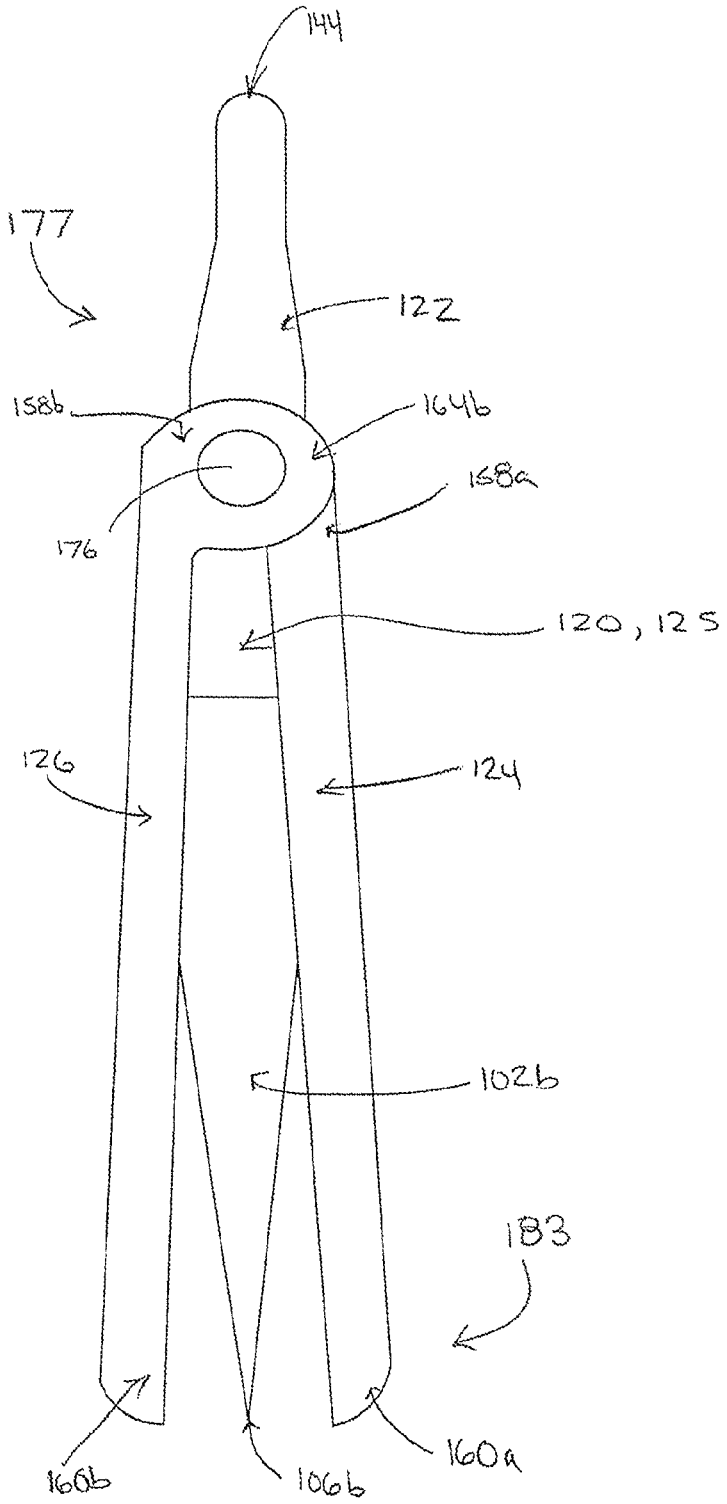
FIG. 7 is a side view of the applicator of FIG. 1, showing the first and second containers of FIG. 5 mounted to the applicator, and showing the panels squeezing the containers; and, FIG. 8 is a side plan view of an second embodiment of FIG. 1 wherein one of the panels is mounted to the base and the second panel is pivotally mounted to the distal end of the first panel.

Referring to FIG. 7, in the embodiment shown, due to the mounting of the panels 124, 126, the panels 124, 126 are configured to sequentially compress from one end of the containers 102*a*, 102*b* to the other end of the containers 102*a*, 102*b*. That is, the applicator 100 has a first proximal end 177 proximate the nozzle 122, and a second distal end 183 opposed to the first end 177. As the pivot point is adjacent the first end 177, the panels 124, 126 will initially compress a portion of the containers 102*a*, 102*b* positioned at the first end 177. As the containers 102*a*, 102*b* are emptied, and the panels 124, 126 move closer towards each other, the panels 124, 126 will begin to compress the portion of the containers 102*a*, 102*b* positioned at the second end 183.

Figure 8:
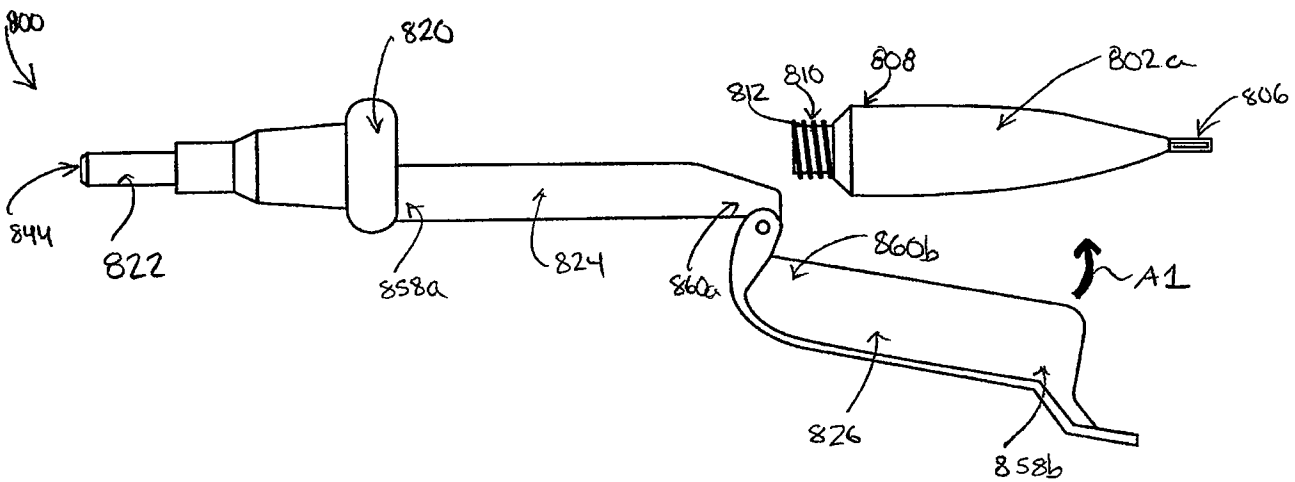

In an alternate embodiment, the panels may be configured to initially compress a portion of the containers positioned adjacent the second end. For example in the embodiment shown in FIG. 8, wherein like numerals are referred to with like elements, with the first digit incremented to 8 to refer to the figure number, the panels 824 and 826 are pivotally mounted together at the second ends 860*a*, 860*b* thereof. The first end 858*a* of the first panel 824 is optionally fixedly mounted to the base 820, and the first end 858*b* of the second panel 826 is freely rotatable, as indicated by arrow A1. As panel 826 rotates in the direction of arrow A1, the tubes are compressed from the distal ends towards the outlet or proximate ends.

Referring back FIGS. 1 to 6, in use, a user may remove the caps 116*a*, 116*b* from each of the squeeze tubes 102*a*, 102*b*, respectively. The user may then pivot the panels 124, 126 away from each other, and mount the squeeze tubes 102*a*, 102*b* to the applicator 100 between the panels 124, 126, for example by screwing the first squeeze tube 102*a* into the first mount 128*a*, and the second squeeze tube 102*b* into the second mount 128*b*. As the squeeze tubes 102*a*, 102*b* are mounted to the applicator 100, the optional seal rupture members 178*a*, 178*b* may rupture the seals 118*a*, 118*b* of the squeeze tubes 102*a*, 102*b*. The user may then pivot the panels 124, 126 back towards each other, and apply pressure to the panels 124, 126 to compress the squeeze tubes 102*a*, 102*b*. As the squeeze tubes 102*a*, 102*b* are compressed, the components of each tube will be dispensed from the tube, will pass through the base 120 and into the nozzle 122, will be mixed in the nozzle 122, and the mixture will be dispensed through the nozzle 122. The user may apply the mixture to their hair (or another person's hair) as the tubes are compressed.

In an alternate embodiment (not shown), an applicator of the present application may be used to dispense a two-component hair treatment product that is provided in only one container. For example, the two components may be housed in a single squeeze tube, which may have a barrier therein for keeping the components separate. In such an embodiment, the applicator may comprise a base having only one mount.

In the embodiment shown, the panels 124, 126 are manually squeezed together to compress the tubes 102*a*, 102*b*. In an alternate embodiment (not shown), the applicator 100 may be electric. For example, the applicator 100 may be battery operated, or may comprise an electrical plug. Further, a motor may be provided, such as in the base 120, which may pivot at least one of the panels 124, 126 inwardly upon actuation of a switch. For example, in the embodiment of FIGS. 1-7, the motor may have a threaded shaft extending outwardly from each end and may be provided adjacent or in the base 120. Each panel 124, 126 may have a threaded passage in which one of the threaded shafts is received. As the motor is actuated in a first direction, it may draw the panels 124, 126 towards each other due to the rotation of the shafts. When the motor is actuated in the opposite direction, it may draw the panels 124, 126 away from each other due to the rotation of the shafts in the threaded passages.

In a further alternate embodiment (not shown), the components may be mixed elsewhere in the applicator 100. For example, the nozzle 122 may not be a mixer nozzle, and instead, the base 120 may comprise a mixer rod in one of the passages thereof.

The invention claimed is:

1. An applicator for dispensing a multi-component hair treatment product, the hair treatment product provided in at least first and second containers, the applicator comprising:

a) a base;

b) a nozzle provided on the base, the containers mountable to the base in fluid flow communication with the nozzle; and, c) at least a first panel and a second panel, at least one of the panels provided on the base, at least one of the first panel and the second panel movable toward the other of the first panel and the second panel to compress the containers when the containers are mounted to the applicator and positioned between the first panel and the second panel, and the containers positioned such that each of the first panel and second panel contacts each of the first container and second container when compressing the containers, wherein the panels have a first end proximate the base and a second end spaced from the base, and wherein the panels are pivotally mounted to the base.

2. The applicator of claim 1 wherein the containers are removably mounted to the base.

3. The applicator of claim 1 wherein the nozzle is a mixer nozzle.

4. The applicator of claim 1 wherein the nozzle is removably mounted on the base.

5. The applicator of claim 1 wherein the panels are configured to sequentially compress the containers from one end of the containers to the other end of the containers.

6. The applicator of claim 1 wherein the applicator has a first end proximate the nozzle and a second end opposed to the first end, and the panels are configured to initially compress a portion of the containers positioned at the first end.

7. The applicator of claim 1 wherein the applicator has a first end proximate the nozzle and a second end distal to the nozzle, the panels are configured to initially compress a portion of the containers positioned in the second end.

8. The applicator of claim 1, wherein the base comprises first and second passages in communication with the nozzle.

9. The applicator of claim 8 wherein the base comprises two mounts, each having a mount passage in communication with one of the first and second passages, and each mount is adapted to removably receive a container.

10. The applicator of claim 8 wherein each mount has a seal rupture member, the seal rupture members comprising longitudinally extending members that extends within each mount passage.

11. The applicator of claim 1 wherein the base has a seal rupture member for each of the containers.

12. The applicator of claim 1, wherein the first panel and the second panel are removable from the nozzle and base.

13. The applicator of claim 1, wherein the at least one of the first panel and the second panel is movable in a first direction, and the first and second containers are spaced apart in a second direction transverse to the first direction.

14. An applicator for dispensing a multi-component hair treatment product, the hair treatment product provided in at least first and second containers, the applicator comprising:

a) a base;

b) a nozzle provided on the base, the containers mountable to the base in fluid flow communication with the nozzle; and, c) at least a first panel and a second panel, at least one of the panels provided on the base, at least one of the first panel and the second panel movable toward the other of the first panel and the second panel to compress the containers when the containers are mounted to the applicator and positioned between the first panel and the second panel, and the containers positioned such that each of the first panel and second panel contacts each of the first container and second container when compressing the containers, wherein the applicator has a first end proximate the nozzle and a second end opposed to the first end, and the panels are configured to initially compress a portion of the containers positioned at the first end.

15. The applicator of claim 14 wherein the first panel is fixedly mounted with respect to the base.

16. The applicator of claim 14 wherein the nozzle is a mixer nozzle.

17. The applicator of claim 16 wherein the nozzle is removably mounted on the base.

18. The applicator of claim 14, wherein the base comprises first and second passages in communication with the nozzle.

19. The applicator of claim 18 wherein the base comprises two mounts, each having a mount passage in communication with one of the first and second passages, and each mount is adapted to removably receive a container.

* * * * *